US009450308B1

(12) United States Patent
Lewis, Jr.

(10) Patent No.: US 9,450,308 B1
(45) Date of Patent: Sep. 20, 2016

(54) ANTENNA SUBSYSTEM AND METHOD FOR SINGLE CHANNEL MONOPULSE TRACKING

(71) Applicant: ViaSat, Inc., Carlsbad, CA (US)

(72) Inventor: Donald Ray Lewis, Jr., Conyers, GA (US)

(73) Assignee: ViaSat, Inc., Carlsbad, CA (US)

( * ) Notice: Subject to any disclaimer, the term of this patent is extended or adjusted under 35 U.S.C. 154(b) by 715 days.

(21) Appl. No.: 13/656,710

(22) Filed: Oct. 21, 2012

Related U.S. Application Data

(60) Provisional application No. 61/549,879, filed on Oct. 21, 2011.

(51) Int. Cl.
*H01Q 13/02* (2006.01)
*H01Q 19/19* (2006.01)

(52) U.S. Cl.
CPC ..... *H01Q 13/025* (2013.01)

(58) Field of Classification Search
None
See application file for complete search history.

(56) References Cited

U.S. PATENT DOCUMENTS 3,373,431 A * 3/1968 Webb ..... G01S 13/4409 333/21 R
4,096,482 A * 6/1978 Walters ..... H01Q 21/245 342/373
4,246,583 A * 1/1981 Profera ..... H01Q 25/04 333/21 R
5,025,493 A 6/1991 Cook, Jr.

OTHER PUBLICATIONS

Cook, J.H., An Improved Scanning Automatic Tracking Antenna for Telemetry Applications, ITC Proceeding 1989 p. 235-242.
Cook, J.H., A New Extended Bandwidth ESCAN® "L-band and S-band Tracking Antenna", ITC Proceedings 1990 p. 193-202.
Cook, J.H., An Improved Electronic Scan Tracking Antenna for S-band Telemetry and Remote Sensing Applications, Telesystems Conference 1991 vol. 1 p. 291-296.
Radar Handbook Second Edition, edited by Merrill I. Skolnik, published by McGraw Hill Publishing Company, 1990, pp. 18.1 to 18.25.
Printout from website http://www.microwaves101.com/encyclopedia/monopulseantennas.cfm accessed on Oct. 18, 2011.
Printout from website http://www.microwaves101.com/encyclopedia/monopulsecomparator.cfm access on Oct. 18, 2011.

* cited by examiner

*Primary Examiner* — Robert Karacsony
(74) *Attorney, Agent, or Firm* — Holland & Hart LLP

(57) ABSTRACT

An antenna subsystem having advantageous characteristics for single channel monopulse tracking applications is described. The antenna subsystem may include an array of wave guides such as a square array of four wave guides operating in a monopulse tracking operating frequency band. A single aperture horn may be connected with the array such that one or more wave guide geometry transitions deliberately generates higher order modes. The single aperture horn may be configured such that the dominant mode and the higher order modes combine to generate a corresponding radiation pattern having an enhanced symmetry and/or uniformity. A wave guide circuit may be coupled with the array and configured to generate one or more signals usable to track a moving target such as an elevation error tracking signal and an azimuth error tracking signal.

15 Claims, 7 Drawing Sheets

ANTENNA SUBSYSTEM AND METHOD FOR SINGLE CHANNEL MONOPULSE TRACKING

CROSS-REFERENCE TO RELATED APPLICATIONS

This application claims the benefit of U.S. Provisional Application No. 61/549,879, filed Oct. 21, 2011, titled "Single Aperture Four Waveguide Tracking Antenna Feed," the contents of which are hereby incorporated in its entirety by reference.

TECHNICAL FIELD

This invention pertains generally to antennas and, more particularly, to microwave antennas.

BACKGROUND

Conventional feed designs for single channel monopulse autotracking antennas typically involve a compromise between tracking angular resolution and optimum antenna gain and/or sidelobe radiation patterns. This compromise can result in severe performance limitations for applications involving so-called high dynamic targets such as low attitude ground launched missiles.

Some conventional single channel monopulse antenna feed designs utilize a four element phased array. Such designs typically provide good tracking sensitivity, but have compromised data performance (e.g., with respect to noise). Some conventional single channel monopulse attenna feed designs utilize a five element phased array. These designs typically compromise tracking sensitivity at the expense of better data performance. Some conventional antenna feed designs utilize a four horn array. These designs can provide good tracking sensitivity, but typically have non-uniform primary radiation patterns that result in less than desirable aperture efficiencies and higher than desired secondary sidelobe levels. In contrast, some conventional feed designs that utilize a five element array have improved radiation patterns relative to four horn arrays, but can suffer from relatively poor error channel tracking gradients due to higher element offset distances with a result being poor performance when autotracking high dynamic targets.

Embodiments of the invention are directed toward solving these and other problems individually and collectively.

SUMMARY

An antenna subsystem having advantageous characteristics for single channel monopulse tracking applications is enabled. The antenna subsystem may include an array of wave guides such as a square array of four wave guides. The array of wave guides may have a dominant propagation mode in a monopulse tracking operating frequency band. The antenna subsystem may further include a single aperture horn connected with the array such that one or more wave guide geometry transitions (e.g., an abrupt change in wave guide width) deliberately generates higher order modes. The single aperture horn may include a straight section and a flared section arranged such that the dominant mode and the higher order modes combine to generate a corresponding radiation pattern having a greater symmetry and/or uniformity. The antenna subsystem may further include a wave guide circuit coupled with the array and configured to generate one or more signals usable to track a moving target such as an elevation error tracking signal and an azimuth error tracking signal. For example, the wave guide circuit may include a set of magic tee junctions compensated to operate over a significant portion of the monopulse tracking operating frequency band.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF THE DRAWINGS

Illustrative embodiments of the present invention are described in detail below with reference to the following drawing figures.

Note that the same numbers are used throughout the disclosure and figures to reference like components and features.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In accordance with at least one embodiment of the invention, an antenna subsystem with desirable characteristics for single channel monopulse tracking applications is provided. The antenna subsystem may incorporate a four element wave guide array (e.g., a four element square wave guide array) and intentionally excite higher order wave propagation modes ("higher order modes") to shape a primary radiation pattern inside an over-mode wave guide section (e.g., a horn that illuminates a secondary reflector). Antenna subsystem geometry may be chosen such that dominant and higher order modes combine to enhance radiation pattern symmetry and/or uniformity relative to the dominant propagation mode. The enhanced radiation patterns have relatively low side lobe levels and can provide good reflector illumination, which in turn can provide for high secondary efficiencies and low secondary side lobes. Tracking advantages of the four element array (e.g., desirable tracking error slope modulations) may be maintained while providing desirable reflector illumination characteristics more typical of a five element array.

In accordance with at least one embodiment of the invention, the antenna subsystem may have a monopulse tracking operating frequency band in the microwave C-band (e.g., 4 GHz to 8 Ghz) and, in particular, in a range for target tracking applications of 4.4 GHz to 5.25 Ghz. The antenna subsystem may incorporate a wave guide circuit capable of processing signals output by the four element wave guide array to generate tracking error signals including an elevation error tracking signal and an azimuth error tracking signal. The wave guide circuit may generate the tracking error signals at least in part with so-called magic tee wave guide junctions that have been compensated to perform in the monopulse tracking operating frequency band. The wave guide circuit may separately process left and right hand circularly polarized signals from the four element wave guide array for use by a tracking signal processor.

Figure 1:
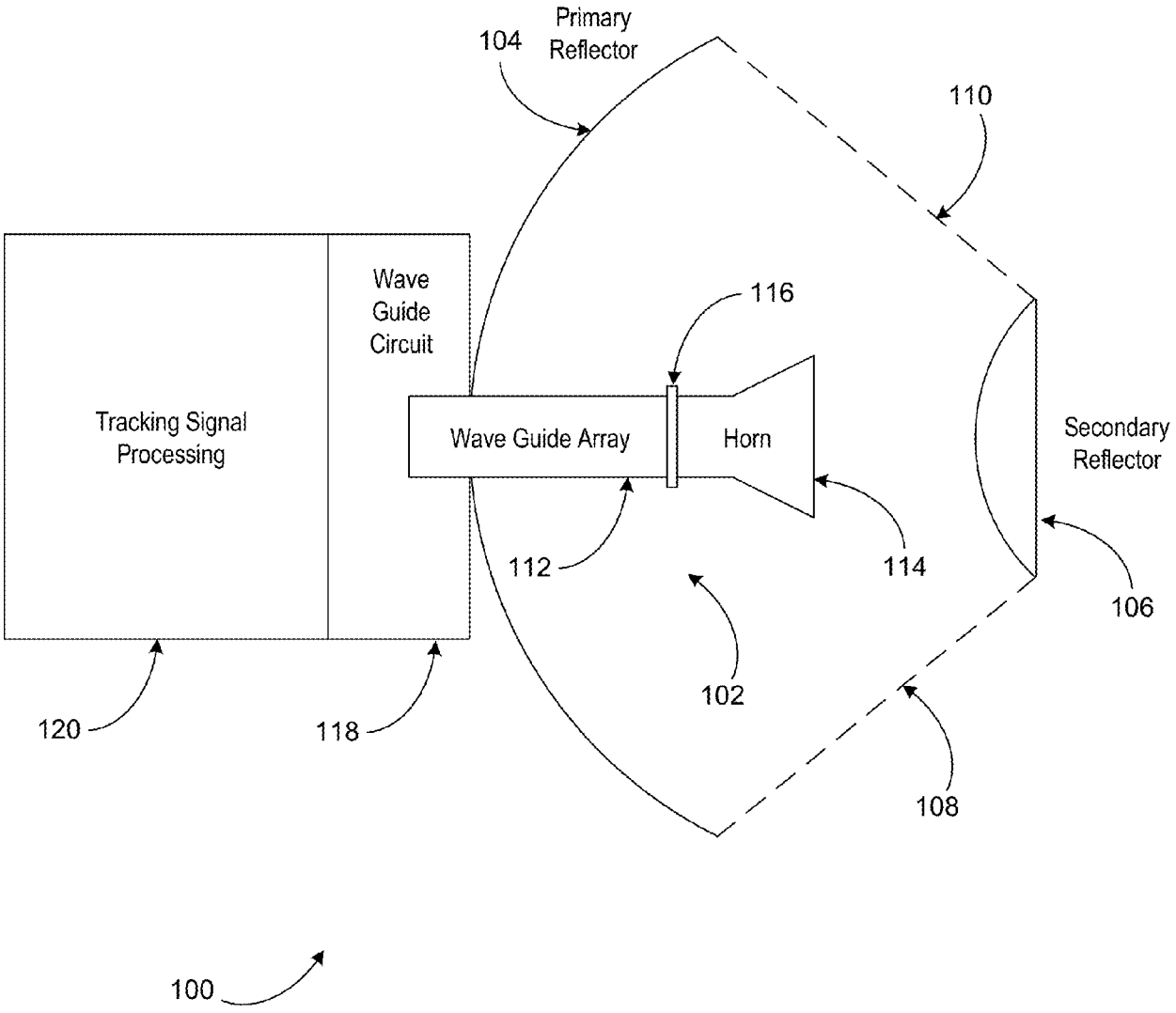
FIG. 1 is a schematic diagram depicting aspects of an example antenna in accordance with at least one embodiment of the invention.

For clarity, this description uses the example of an antenna having a secondary reflector or sub-reflector that is illuminated by an antenna feed, however, each embodiment is not so limited. FIG. 1 depicts aspects of an example antenna 100 in accordance with at least one embodiment of the invention. An antenna feed 102 is disposed through a primary reflector 104 (e.g., a parabolic reflector) to illuminate a secondary reflector 106 (e.g., a convex reflector). The secondary reflector 106 may be connectively coupled with the primary reflector 104 utilizing one or more support struts such as support struts 108 and 110, and is sometimes called a subreflector.

The antenna feed 102 may include a wave guide array 112 coupled with a horn 114. The wave guide array 112 and the horn 114 may be integral or, as depicted in FIG. 1, may be coupled with any suitable coupling mechanism 116 including suitably disposed coupling flanges of the wave guide array 112 and the horn 114. Examples of suitable manufacturing techniques include dip brazing, electroforming and torch brazing. The wave guide array 112 may include a symmetrically arranged array ("symmetrical array") of conductive wave guides such as a square array of four wave guides. Each wave guide in the array may have dimensions that yield a corresponding dominant propagation mode in the chosen operating frequency band. The antenna feed 102 may include one or more abrupt geometry transitions configured to generate one or more higher order modes in the horn 114. The horn 114 may be a single aperture horn configured to cause a superposition of the dominant mode and the higher order modes such that the radiation pattern of the combined dominant and higher order modes has a greater symmetry and/or uniformity relative to that of the dominant mode. The antenna feed horn 114 is described in more detail below with reference to FIG. 2.

The antenna feed 102 may further include a wave guide circuit 118 configured to receive input from the wave guide array 112 and generate a set of tracking signals for further processing by one or more tracking signal processing components 120. For example, the wave guide circuit 118 may generate one or more tracking error signals such as an elevation error tracking signal ("Δ EL") and an azimuth error tracking signal ("Δ AZ"). The wave guide circuit 118 may be coupled with the wave guide array 112 utilizing any suitable wave guide coupler such as a 90 degree hybrid coupler. The circuit 118 may be implemented using coaxial components and/or further waveguide components. The tracking signal processing components 120 may include any suitable tracking signal processing components configured to utilize the output of the wave guide circuit 118 for a suitable tracking application including tracking of moving targets and high dynamic targets in particular.

Figure 2:
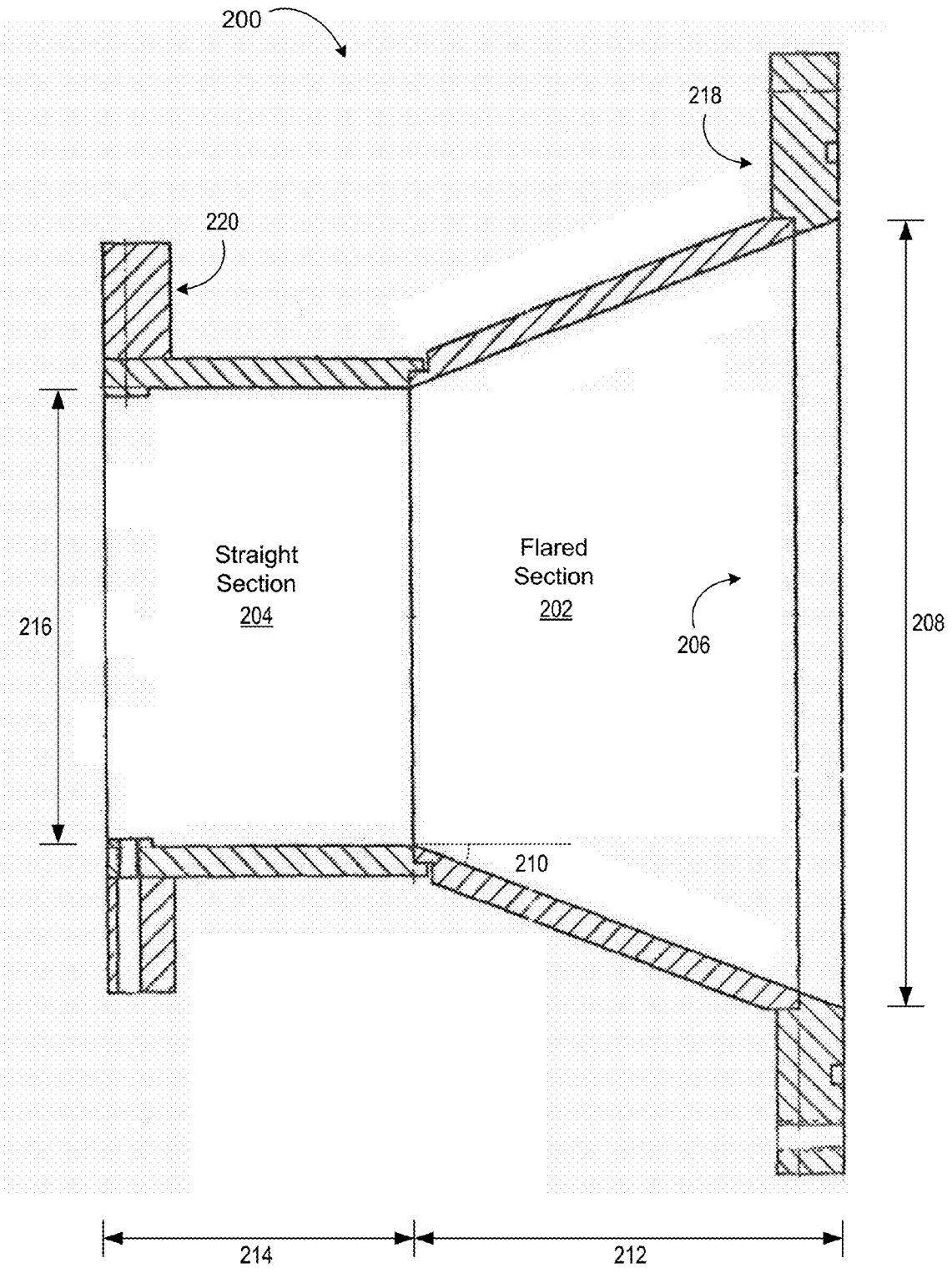
FIG. 2 is a schematic cross-section diagram depicting aspects of example single aperture horn in accordance with at least one embodiment of the invention.

FIG. 2 depicts aspects of an example antenna feed horn 200 in accordance with at least one embodiment of the invention. FIG. 2 is a schematic cross-section of the horn 200 and is not necessarily to scale. The antenna feed horn 200 is an example of the horn 114 of FIG. 1. The antenna feed horn 200 is a single aperture horn having a flared section 202 coupled with a straight section 204. The horn 200 may be the final or outermost aperture section of the antenna feed 102. That is, the horn 200, and in particular the flared section 202 of the horn 200, may be the first to encounter a received signal from the secondary reflector 106. The outer aperture 206 of the flared section 202 (having a width 208) may be sized to provide suitable electromagnetic illumination of the secondary reflector 106, for example, based on the geometry and location of the secondary reflector 106. Closed form H-plane rectangular aperture equations may be utilized to determine, at least in part, a suitable width 208 of the outer aperture 206 of the flared section 202.

The change in geometry between the straight section 204 and the flared section 202 may correspond to an abrupt wave guide geometry transition capable of generating higher order modes, as may the change in geometry between the horn 114 and the wave guide array 112 (referring back to FIG. 1). The flare angle 210 may be chosen to control the generated higher order modes, as well as to arrange for superposition of the generated higher order modes with the dominant mode of the wave guide array 112. For example, the effect of various values of the flare angle 210 and the flared section length 212 may be numerically modeled and optimized. The same is true of the length 214 and width 216 of the straight section 204. In accordance with at least one embodiment, the geometry of the horn 200 is chosen to generate higher order modes and cause superposition of the higher order modes with the dominant mode such the electromagnetic radiation pattern of the combined modes has a greater symmetry and/or uniformity relative to the radiation pattern of the dominant mode. For example, the width 216 of the straight section 204 and the flare angle 210 of the flared section 202 may be varied to generate suitable higher order modes, and the length 214 of the straight section may be adjusted to an optimally symmetric (e.g., approximately and/or substantially symmetric) radiation pattern at the outer aperture 206 of the horn 200.

The antenna feed horn 200 may have an outer flange 218 suitable for coupling the horn 200 to a corresponding flange of a dielectric radome to inhibit moisture ingress, and a coupling flange 220 suitable for coupling the horn 200 to a corresponding flange of the wave guide array 112. A plurality of tuning pins may be disposed into the interior of the horn 200, for example, from septums of the wave guide array 112, as described below in more detail with reference to FIG. 3.

Figure 3:
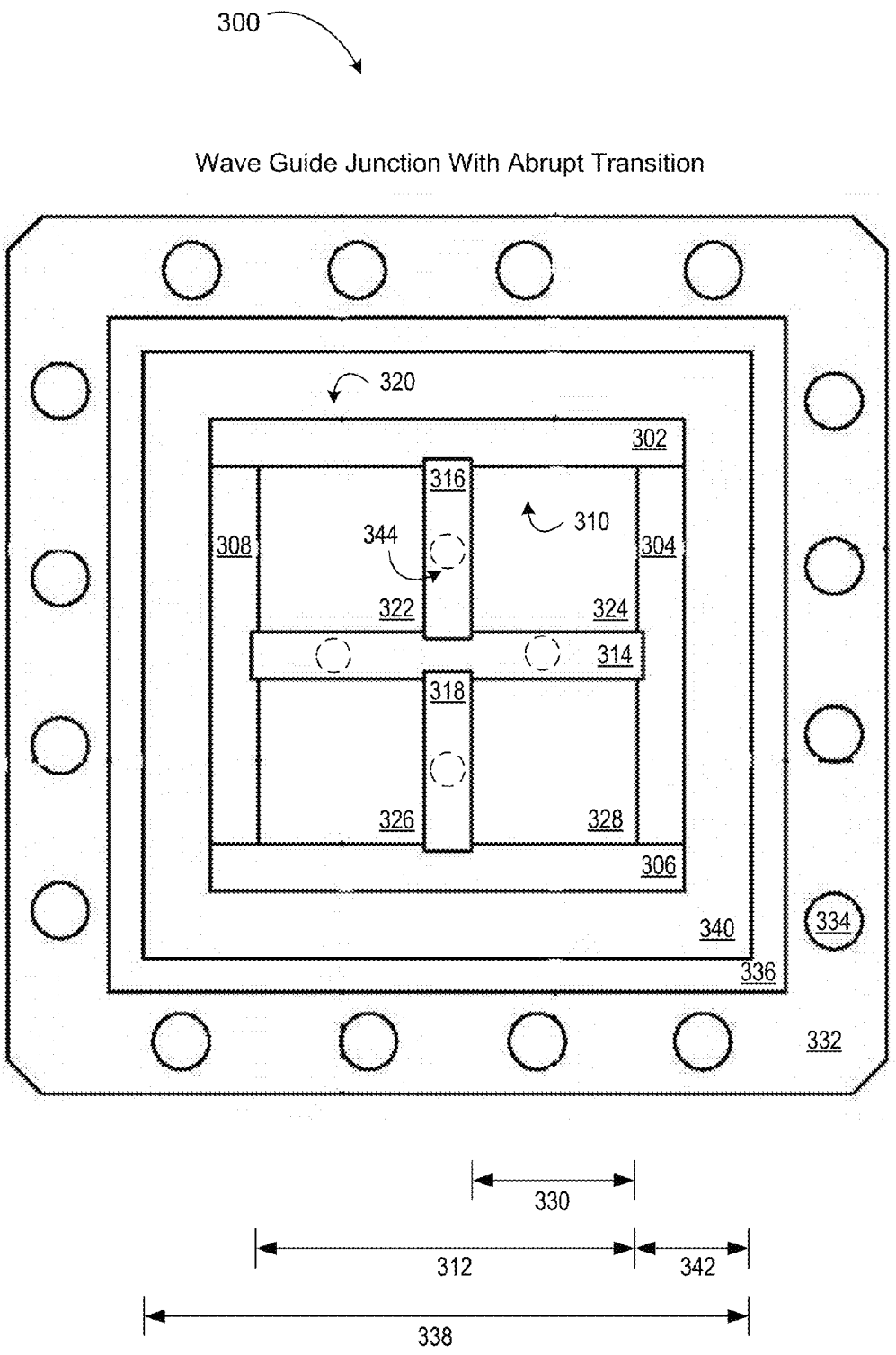
FIG. 3 is a schematic cross-section diagram depicting aspects of an example wave guide array with coupling in accordance with at least one embodiment of the invention.

FIG. 3 depicts aspects of an example wave guide array with coupling 300 in accordance with at least one embodiment of the invention. FIG. 3 is a schematic cross-section of the wave guide array with coupling 300 and is not necessarily to scale. The wave guide array with coupling 300 is an example of the wave guide array 112 and coupling 116 of FIG. 1. Conductive walls 302, 304, 306, 308 of a wave guide 310 having width 312 may be divided by septums 314, 316, 318 to form a square four element array 320 of square wave guides 322, 324, 326, 328 each having width 330. A coupling flange 332 and connectors (circles in FIG. 3 like circle 334) may be utilized to couple the wave guide array 320 with the corresponding flange 220 of the horn 200 of FIG. 2. The region 336 may correspond to the conductive walls of the straight section 204 of the horn 200 of FIG. 2. The region 336 may therefore define a single aperture wave guide of width 338 corresponding to the width 216 of the straight section 204 of FIG. 2.

The wave guide array with coupling 300 may include an abrupt step transition 340 between the wave guide array 320 and the straight section 336 of the coupled horn. As shown in FIG. 3, the effective increase in waveguide width 342 may include the width of a wall (e.g., wall 304) of the wave guide array 320. This abrupt step transition 340 is an example of a wave guide geometry transition capable of generating higher order modes. In accordance with at least one embodiment of the invention, the effective increase in waveguide width 342 may be nonzero, however, each embodiment of the invention is not so limited. In accordance with at least one alternative embodiment of the invention, the effective increase in waveguide width 342 is zero (i.e., the width 338 of the straight section 336 is approximately and/or substantially equal to the width 312 of the waveguide 310). Nevertheless, even in this case the transition from wave guide array 320 (including septums 314, 316, 318) to the straight section 336 of the horn may generate higher order modes, although of a different nature, and these may be sufficient to gain advantage from a configured superposition with the dominant mode. As further alternates, the straight section 204 (referring back to FIG. 2) may also be flared so that the horn 200 includes multiple flared sections with different flare angles. As further alternatives, the horn 200 may include multiple pairs of straight and flared sections and/or a set of abrupt step transitions.

In accordance with at least one embodiment of the invention, the effective increase in waveguide width 342, also called the abrupt horn step 342, may be varied, along with horn 200 (FIG. 2) section lengths 212, 214 and/or flare angle 210 to force phase centers of the fundamental and higher order modes to be substantially coincident in the outer aperture 306 of the horn 200 (since the dominant and higher order modes have different waveguide velocity factors) thereby, at least in part, optimizing the amplitude of higher order mode components of the combined radiation pattern. In accordance with at least one embodiment of the invention, the width 330 of the elements 322, 324, 326, 328 of the array 320 may have a width between 0.5 and 1.0 wavelengths at the center frequency of operation (e.g., the center frequency of the monopulse tracking operating frequency band). In accordance with at least one embodiment of the invention, the width 338 of the straight section 336 of the horn may be set to a value between 1.0 and 2.0 wavelengths a the center frequency of operation. In accordance with at least one embodiment of the invention, the length 214 (FIG. 2) of the straight section 204 of the horn 200 may be set to a value between 0.5 and 2.0 wavelengths at the center frequency of operation. In accordance with at least one embodiment of the invention, the flare angle 210 of the flared section 202 may be set to a value between 15 and 30 degrees. In accordance with at least one embodiment of the invention, the length 212 of the flared section 202 may be set to a value between 1.0 and 5.0 wavelengths at the center frequency of operation.

The wave guide array with coupling 300 may further include multiple tuning pins (indicated in FIG. 3 by dashed circles like dashed circle 344) that may be disposed into the interior of horn 200 when the wave guide array with 300 is attached to the horn 200. As shown in FIG. 3, the tuning pins may be connectively coupled with the septums 314, 316, 318 of the wave guide array 320. The geometry of the tuning pins may be adjustable to improve electrical isolation between the ports 322, 324, 326, 328 of the wave guide array 320, as well as the impedance match of the horn 200 (FIG. 2). For example, cylindrical pins with a height and/or a diameter of between 0.05 and 0.2 wavelengths of the center frequency of operation may be coupled with the septums 314, 316, 318 and protrude into the horn 200.

Figure 4:
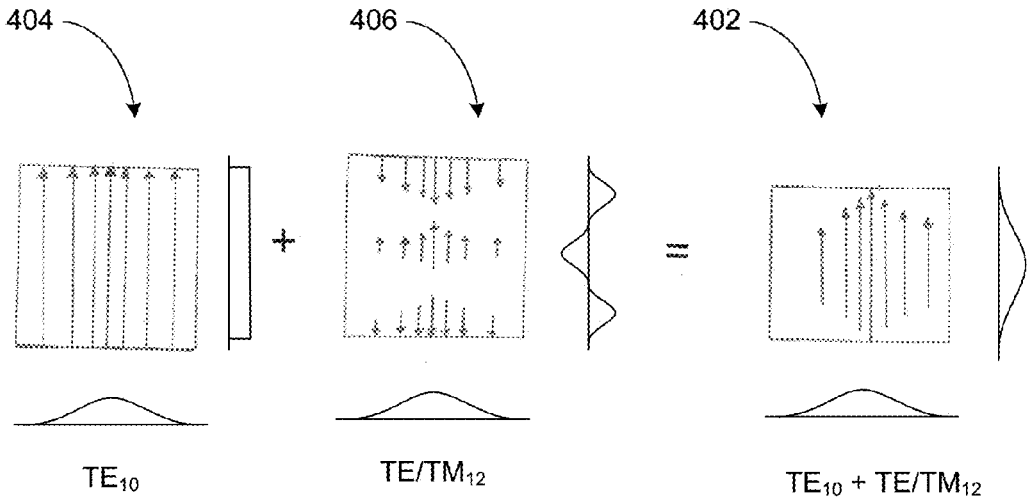
FIG. 4 is a radiation pattern diagram depicting aspects of an example superposition in accordance with at least one embodiment of the invention.

FIG. 4 depicts aspects of an example superposition 402 of an example dominant wave guide mode 404 and an example higher order mode 406. The dominant wave guide mode 404 corresponds to a dominant transverse electric (TE) mode in the hollow rectangular wave guide, denoted $TE_{10}$. The higher order mode 406 corresponds to a particular higher order transverse electromagnetic (TE/TM) mode in the wave guide, denoted $TE/TM_{12}$. The superposition 402 of the dominant 404 and higher order 406 is denoted $TE_{10}+TE/TM_{12}$ and can be utilized to obtain a more uniform illumination of the secondary reflector 108 relatively to the dominant mode 404. The radiation pattern of the superposition 402 has a greater symmetry than the radiation pattern of the dominant wave guide mode 404. The antenna feed 102 (referring back to FIG. 1) may include one or more abrupt geometry transitions to generate higher order modes such that the superposition of the higher order modes with a dominant mode modifies the E-plane radiation pattern of the dominant mode to be more similar (e.g., approximately and/or substantially equal) to the H-plane radiation pattern, resulting in approximate and/or substantial electromagnetic radiation pattern symmetry. In accordance with at least one embodiment of the invention, improved electromagnetic radiation pattern symmetry results in improved single channel monopulse tracking performance (e.g., improved tracking error signal slopes).

The wave guide array 112 (FIG. 1) may be communicatively coupled with the wave guide circuit 118 utilizing any suitable set of wave guide couplers, sometimes called wave guide adaptors. For example, each of the elements 322, 324, 326, 328 of the wave guide array 320 of FIG. 3 may be coupled to the wave guide circuit 118 with a pair of 90 degree hybrid couplers disposed through the wave guide 310 wall such that each of the pair is substantially orthogonal to one another in the plane transverse to signal propagation. In accordance with at least one embodiment of the invention, a pair of couplers so disposed may provide right hand and left hand circularly polarized components of the signal in each array 320 element as separate inputs to the wave guide circuit 118. Accordingly, the wave guide circuit 118 may receive a set of right hand circularly polarized signals corresponding to the four elements 322, 324, 326, 328 of the wave guide array 320 and a separate set of left hand circularly polarized signals corresponding to the four elements 322, 324, 326, 328 of the wave guide array 320. In accordance with at least one embodiment of the invention, these separate sets of signals may be processed separately by the wave guide circuit 118. For example, the wave guide circuit 118 may include a set of circuit components, such as those depicted in FIG. 5, dedicated to each polarization and producing corresponding tracking error signals which are then provided separately to the tracking signal processing components 120.

Figure 5:
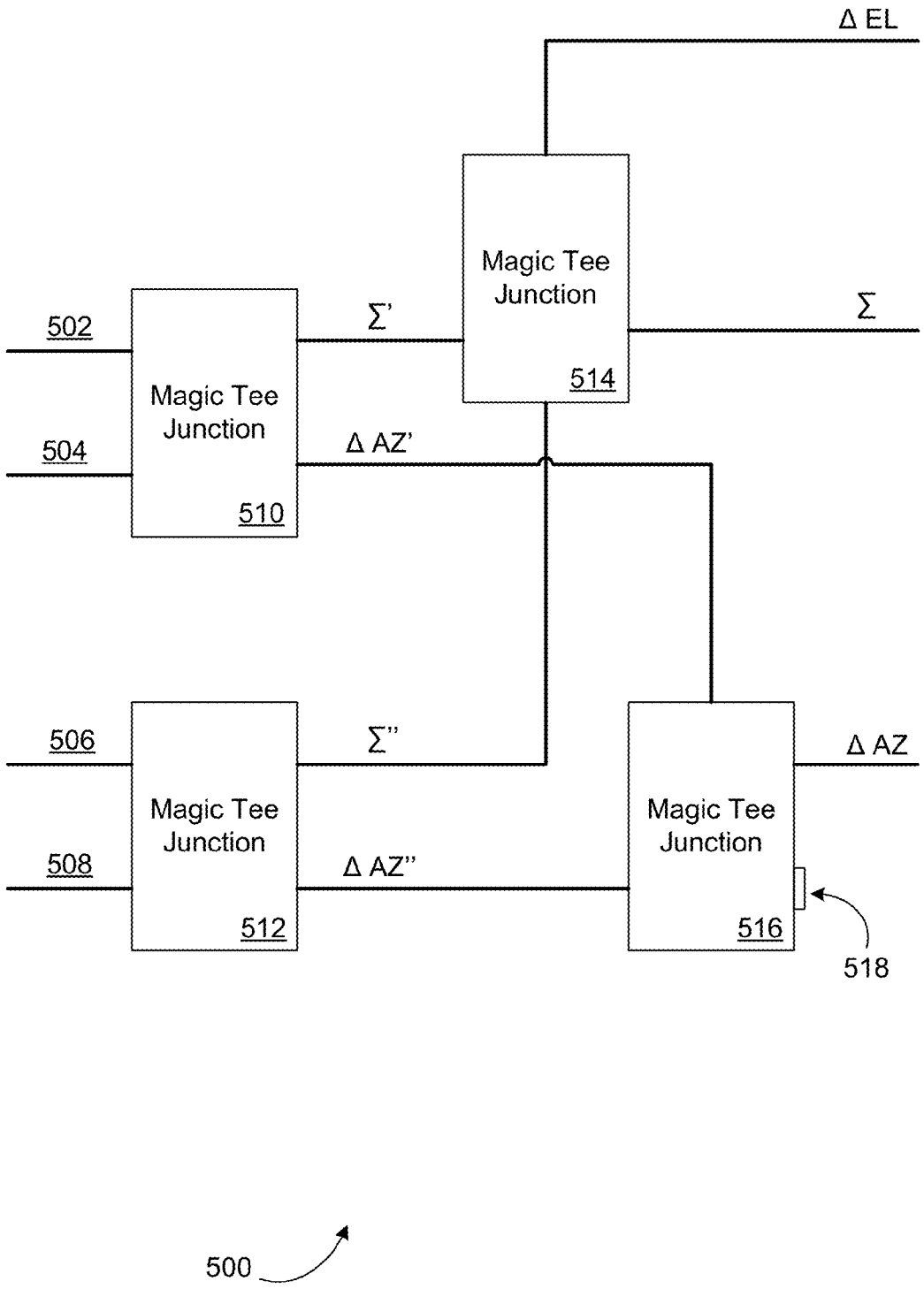
FIG. 5 is a schematic diagram depicting aspects of an example wave guide circuit in accordance with at least one embodiment of the invention.

FIG. 5 depicts aspects of an example circuit 500 suitable for inclusion in the wave guide circuit 118 of FIG. 1. The circuit 500 receives four inputs 502, 504, 506 and 508 corresponding to signals received from the four elements 322, 324, 326 and 328, respectively, of the wave guide array 320 of FIG. 3. For example, the inputs 502, 504, 506, 508 may correspond to a right hand circularly polarized or a left hand circularly polarized set of received signals. A first pair of received inputs 502, 504 may be input to a first magic tee junction 510 (a magic tee junction is sometimes called a 180 degree hybrid coupler) to generate sum Σ' and difference Δ AZ' signals. The difference signal output by the first magic tee junction 510 may correspond to an azimuth error tracking signal because inputs 502 and 504 correspond to array 320 elements 322 and 324 which have a same vertical, but different horizontal location. Similarly, a second pair of received inputs 506, 508 may be input to a second magic tee junction 512 to generate corresponding sum Σ" and difference Δ AZ" signals.

The sum signals Σ' and Σ" may become a third pair of inputs to a third magic tee junction 514 to generate corresponding sum Σ and difference Δ EL signals. In this case the sum Σ is the sum of each of the input signals 502, 504, 506, 508 and the difference Δ EL may correspond to an elevation error tracking signal because the sum signals Σ' and Σ" correspond to array 320 (FIG. 3) elements 322, 324 and 326, 328, respectively, which differ by vertical location in the array 320. A fourth magic tee junction 516 having one output port suitably terminated 518 may be utilized to generate a sum Δ AZ of the generated azimuth signals Δ AZ' and Δ AZ". Alternatively, a splitter/combiner may be used in place of the fourth magic tee junction 516.

The outputs of the example circuit 500 are thus the sum signal Σ, the elevation error tracking signal Δ EL and the azimuth error tracking signal Δ AZ. These, and another similar set corresponding to the other polarization, may be provided directly to the tracking signal processing components 120 for further processing. In particular, the sum signal Σ may be provided to a low noise amplifier (LNA) of the tracking signal processing components 120 as data and as a tracking reference signal. The output of the low noise amplifier may be utilized for tracking and/or demodulating he elevation error tracking signal Δ EL and the azimuth error tracking signal Δ AZ. For example, the tracking error signals Δ EL and Δ AZ may be multiplexed and/or time sequenced into a single error signal, for example, using a suitable signal switch. Further signal switches may be incorporated in the tracking signal processing components 120, for example, switches may be utilized in combination with further low noise amplifiers to maintain an error signal and its inverse for absolute target direction (e.g., up/down, right/left) to be used in an autotracking process. In at least one embodiment of the invention, one or more such tracking signal processing components 120 may be incorporated into the wave guide circuit 118.

Figure 6:
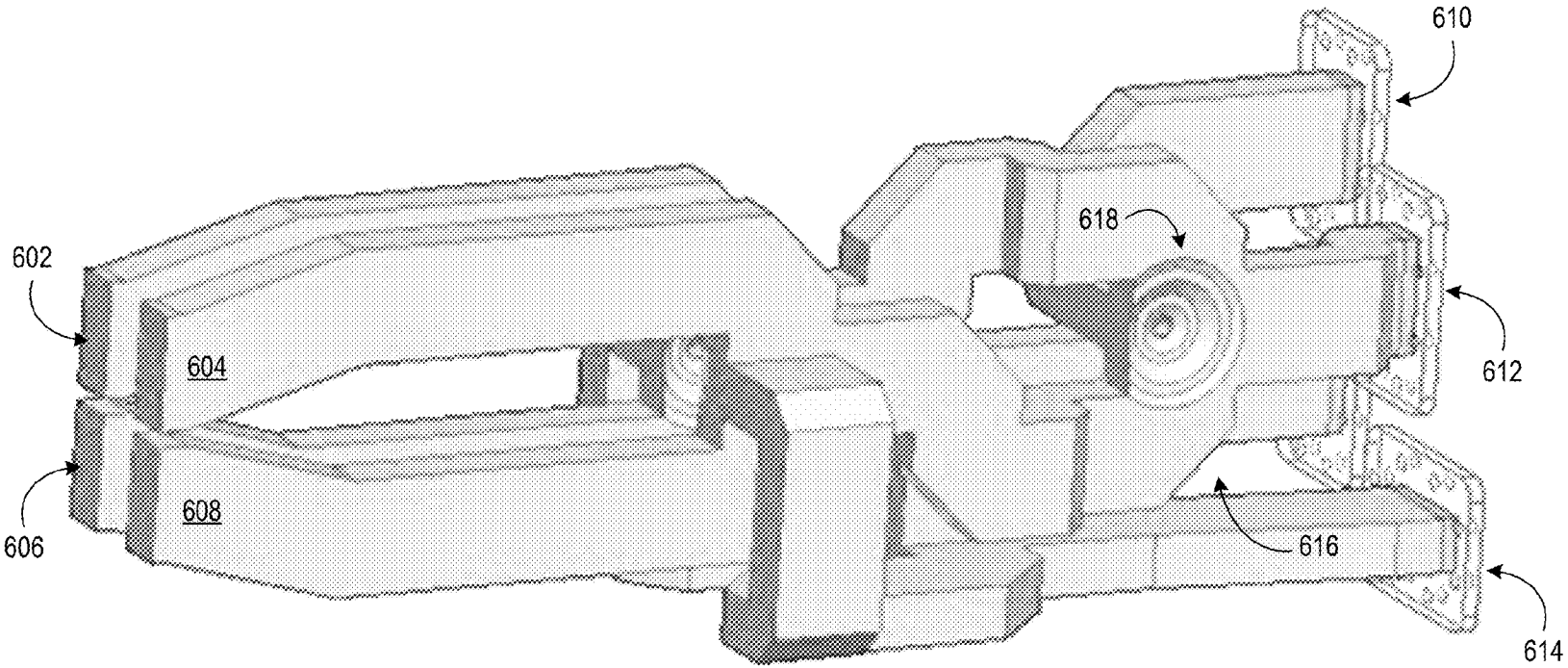
FIG. 6 is a schematic diagram depicting aspects of another example wave guide circuit in accordance with at least one embodiment of the invention.

FIG. 6 depicts aspects of an example circuit 600 in accordance with at least one embodiment of the invention. The circuit 600 of FIG. 6 is an example of the circuit 500 of FIG. 5. The example circuit 600 includes inputs 602, 604, 606, 608 corresponding to the inputs 502, 504, 506, 508 of the circuit of FIG. 5. Outputs 610, 612, 614 may also correspond to the outputs Δ EL, Σ, Δ AZ of FIG. 5. FIG. 6 depicts a magic tee junction 616 corresponding to a magic tee junction 514 of FIG. 5. In addition, FIG. 6 shows the magic tee junction 616 incorporating a stepped matching cone 618, a conducting cone used in the circuit 600 for impedance matching. Each magic tee junction in the circuit 600 (and circuit 500) may include such a matching cone 618. Including such matching cones can enable the circuit 600 to operate (e.g., provide data and tracking radiation patterns) over a significant portion of the monopulse tracking operating frequency band (e.g., at least 17% for some operating bands). A height and diameter of the cones may be adjusted to optimize the portion of the frequency band over which the circuit 600 can operate. In accordance with at least one embodiment of the invention, the height of a stepped matching cone may be set to have a value between 0.4 and 0.7 wavelengths at the center frequency of operation. In accordance with at least one embodiment of the invention, the diameter of a stepped matching cone may be set to have a value between 0.4 and 0.7 wavelengths at the center frequency of operation. A cone may be truncated in either circumference or diameter, typically for mechanical reasons.

Figure 7:
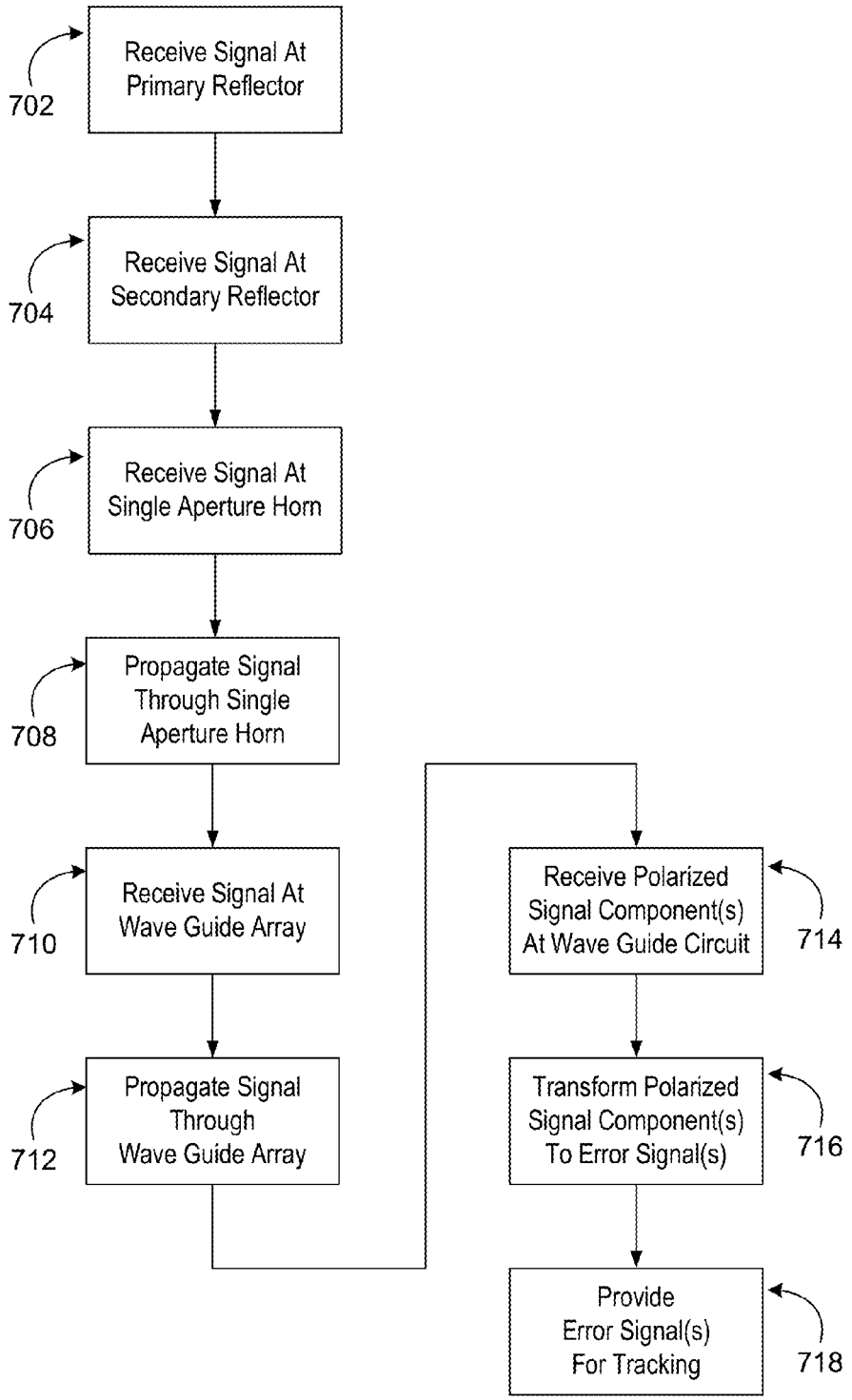
FIG. 7 is a flowchart depicting example steps for single channel monopulse tracking in accordance with at least one embodiment of the invention.

FIG. 7 depicts example steps for single channel monopulse tracking in accordance with at least one embodiment of the invention. At step 702, a signal may be received at a primary reflector. For example, an electromagnetic signal in the monopulse tracking operating frequency band may be received by the primary reflector 104 of FIG. 1. At step 704, the signal may be received at a secondary reflector such as the secondary reflector 106. At step 706, the signal may be received at a single aperture horn such as the single aperture horn 114. At step 708, the signal may be propagated through the single aperture horn. At step 710, the signal may be received at a wave guide array such as the wave guide array 112. At step 712, the signal may be propagated through the wave guide array. At step 714, one or more polarized signal components may be received at a wave guide circuit such as the wave guide circuit 118. At step 716, the polarized signal component(s) may be transformed to one or more error signals. For example, the wave guide circuit 118 may transform the polarized signal components(s) to an elevation error tracking signal and an azimuth error tracking signal. At step 718, the error signal(s) may be provided for tracking. For example, the wave guide circuit 118 may provide the error signal(s) to the tracking signal processing components 120 for further processing.

All references, including publications, patent applications, and patents, cited herein are hereby incorporated by reference to the same extent as if each reference were individually and specifically indicated to be incorporated by reference and/or were set forth in its entirety herein.

The use of the terms "a" and "an" and "the" and similar referents in the specification and in the following claims are to be construed to cover both the singular and the plural, unless otherwise indicated herein or clearly contradicted by context. The terms "having," "including," "containing" and similar referents in the specification and in the following claims are to be construed as open-ended terms (e.g., meaning "including, but not limited to,") unless otherwise noted. Recitation of ranges of values herein are merely indented to serve as a shorthand method of referring individually to each separate value inclusively falling within the range, unless otherwise indicated herein, and each separate value is incorporated into the specification as if it were individually recited herein. All methods described herein can be performed in any suitable order unless otherwise indicated herein or clearly contradicted by context. The use of any and all examples, or exemplary language (e.g., "such as") provided herein, is intended merely to better illuminate embodiments of the invention and does not pose a limitation to the scope of the invention unless otherwise claimed. No language in the specification should be construed as indicating any non-claimed element as essential to each embodiment of the present invention.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without clear indication to the contrary.

As used herein, the term "alternatively" refers to selection of one of two or more alternatives, and is not intended to limit the selection to only those listed alternatives or to only one of the listed alternatives at a time, unless the context clearly indicates otherwise. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

The invention claimed is:

1. An antenna comprising;

a divided wave guide comprising a plurality of individual wave guides having respective wave guide widths for propagation of respective individual signals in an operating frequency band, the divided wave guide having a divided port comprising ports of the plurality of individual wave guides;

a common wave guide horn coupled with the divided waveguide and comprising a plurality of sections between a first end of the common wave guide horn adjacent to the divided port of the divided wave guide and a second end at an outer aperture of the common wave guide horn, the plurality of sections of the common wave guide horn having increasing wave guide cross-sectional size at each geometry transition from the first end to the second end and converting between the individual signals in the plurality of individual wave guides and a composite signal in the common wave guide horn; and a circuit connectively coupled with the plurality of individual wave guides, the circuit comprising a first set of junctions that output a first set of summation signals and a first set of delta signals from the individual signals, and a second set of junctions that output an elevation error tracking signal and an azimuth error tracking signal from the first set of summation signals and the first set of delta signals.

2. An antenna in accordance with claim 1, wherein the common wave guide horn propagates the composite signal to define a combined radiation pattern having an E-plane component that is symmetrical with an H-plane component.

3. An antenna in accordance with claim 1, wherein:

the individual wave guides propagate the respective individual signals in a dominant propagation mode;

the common wave guide horn generates at least one higher-order propagation mode of the dominant propagation mode; and a straight section of the plurality of sections proximate to the first end has a length such that a constructive superposition of the dominant propagation mode and the at least one higher-order propagation mode occurs at the outer aperture of the common wave guide horn.

4. An antenna in accordance with claim 1, wherein the first and second sets of junctions transform similarly polarized individual signals from the individual signals to produce the elevation error tracking signal and the azimuth error tracking signal.

5. An antenna in accordance with claim 1, wherein the circuit is further configured to obtain, from the individual signals, a first set of polarized input signals and a second set of polarized input signals.

6. An antenna in accordance with claim 1, wherein the operating frequency band is between 4 GHz and 8 GHz.

7. An antenna in accordance with claim 1, wherein the outer aperture of the common wave guide horn has a width sized to illuminate a secondary antenna reflector.

8. An antenna in accordance with claim 1, further comprising a set of tuning pins disposed within the common wave guide horn.

9. An antenna in accordance with claim 1, wherein the circuit is further configured to, at least:

obtain, from the individual signals, a first set of input signals associated with a first polarization and a second set of input signals associated with a second polarization;

transform, at least in part, the first set of input signals to a first elevation error tracking signal component and a first azimuth error tracking signal component;

transform, at least in part, the second set of input signals to a second elevation error tracking signal component and a second azimuth error tracking signal component;

generate the elevation error tracking signal with the first elevation error tracking signal component and the second elevation error tracking signal component; and generate the azimuth error tracking signal with the first azimuth error tracking signal component and the second azimuth error tracking signal component.

10. An antenna in accordance with claim 1, wherein the first set of junctions comprise magic tee wave guide junctions to receive the individual signals from the plurality of individual wave guides and the second set of junctions comprise magic tee wave guide junctions to receive outputs from the first set of magic tee wave guide junctions.

11. An antenna in accordance with claim 1, wherein each of the first and second sets of junctions incorporates stepped obstructions.

12. An antenna in accordance with claim 1, further comprising a primary reflector through which the divided wave guide is disposed.

13. An antenna in accordance with claim 1, further comprising a subreflector illuminated by the common wave guide horn.

14. An antenna in accordance with claim 1, wherein the second set of junctions further outputs a sum signal based on a sum of the individual signals.

15. An antenna in accordance with claim 1, wherein the plurality of sections includes at least one straight section and at least one flared section.

* * * * *